US005205335A

United States Patent [19]

Horton et al.

[11] Patent Number: 5,205,335

[45] Date of Patent: Apr. 27, 1993

[54] APPARATUS AND METHOD FOR SELECTIVELY OPENING A PORTION OF A VENETIAN WINDOW BLIND WHILE CLOSING ANOTHER PORTION

[75] Inventors: Walter J. Horton; Don R. Brown, both of Salt Lake City, Utah

[73] Assignee: Blind Ambition, Inc., Salt Lake City, Utah

[21] Appl. No.: 606,499

[22] Filed: Oct. 31, 1990

[51] Int. Cl.[5] ..... E06B 3/48

[52] U.S. Cl. ..... 160/115; 160/168.1; 160/176.1

[58] Field of Search ..... 160/115, 168.1, 176.1, 160/178.1, 178.3

[56] References Cited

U.S. PATENT DOCUMENTS 2,070,110 2/1937 Bennett ..... 160/115

2,459,517 1/1949 Gearhart ..... 160/115

*Primary Examiner*—Blair M. Johnson

*Attorney, Agent, or Firm*—Thorpe North & Western

[57] ABSTRACT

A system, including apparatus and method, for modifying an existing venetian blind so as to maintain a desired portion of the slats in an open or horizontal position, while simultaneously maintaining the remaining portion of slats in a closed or slanted position. The invention provides for a clip and a method of using the same, the clip being attached to one tilt string and the lift string of the blind to prevent movement of both relative to each other below the clip. The second tilt string of the blind is encompassed loosely by the clip, but remains free to move vertically up and down.

18 Claims, 5 Drawing Sheets

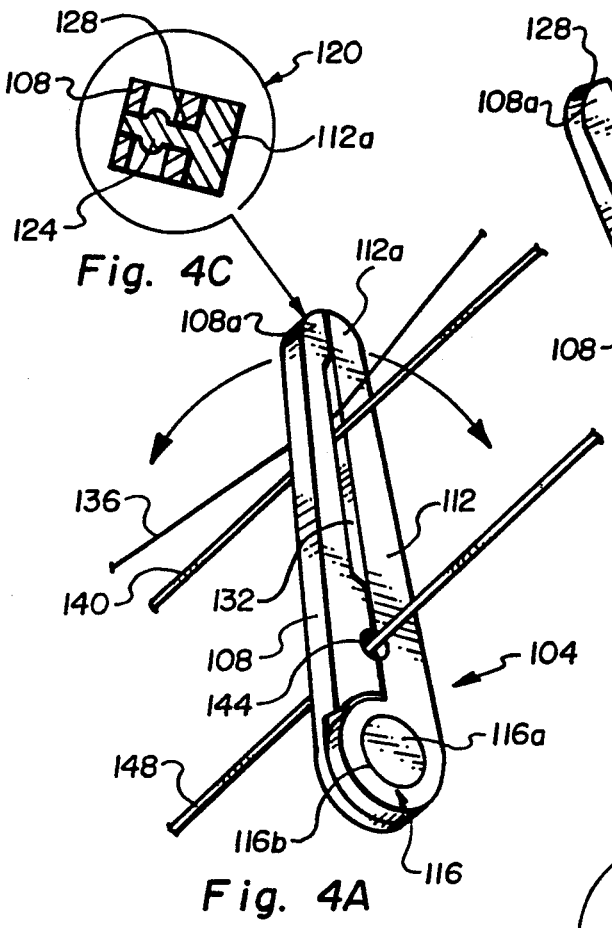
Fig. 4C
Fig. 4A
Fig. 4B
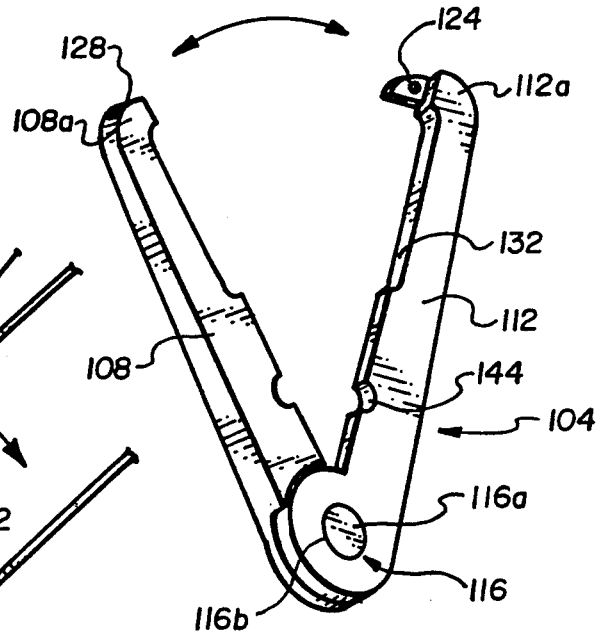
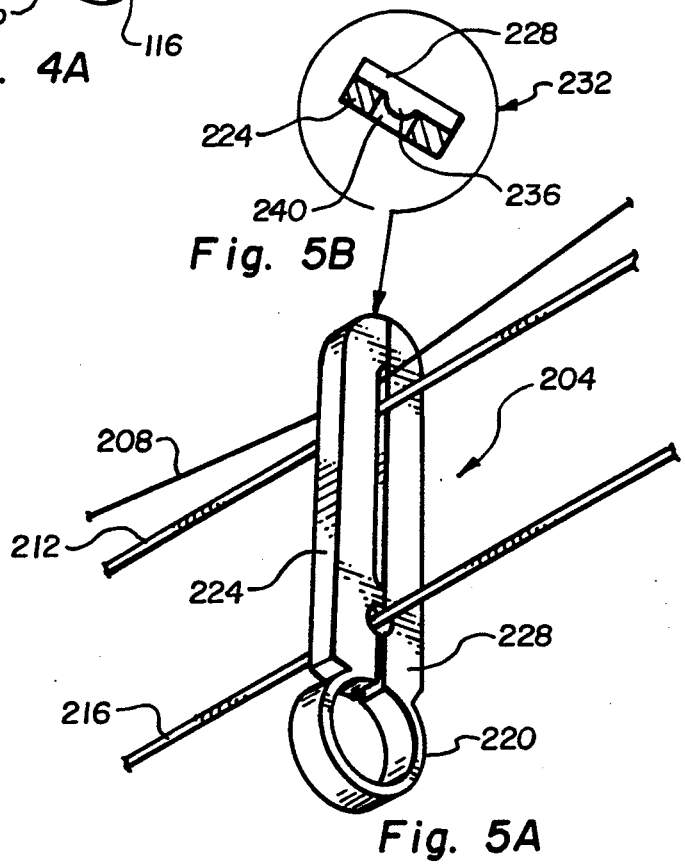
Fig. 5B
Fig. 5A

APPARATUS AND METHOD FOR SELECTIVELY OPENING A PORTION OF A VENETIAN WINDOW BLIND WHILE CLOSING ANOTHER PORTION

BACKGROUND OF THE INVENTION

The present invention relates to an apparatus and method for controlling a venetian blind to allow opening one portion while closing another portion.

Venetian blinds are a well-known type of window covering which allow for selectively and gradually varying the amount of light and/or ventilation allowed to pass from a window through the blind into a room of a dwelling. Such blinds are typically constructed with a plurality of vertically spaced-apart slats which extend horizontally in parallel with one another. The slats are usually held in place by pairs of tilt strings spaced apart along the width of the blind, with a first string of each pair being disposed vertically along a front edge of the slats and a second string of each pair being disposed vertically along the back edge of the slats opposite the first string. Bridging ties extend from the first tilt string to the rear tilt string, providing a support upon which the slats rest.

Generally, a lift string is disposed vertically between the tilt strings of each pair to extend from a head rail at the top of the blind vertically downwardly to a bottom rail positioned at the bottom of the blind, to which the lift string is attached. When the free ends of the lift strings are pulled, an upward movement of the bottom rail occurs and the blind is raised upwardly relative to the window. When the tilt strings of each pair are moved vertically in opposite directions from one another, the slats are caused to rotate about their long axes to thereby vary the rotational position of the slats and thus vary the amount of light and/or ventilation allowed to pass through the blind. Control of the rotation of the slats is typically carried out by a pair of tilt cords or by a hanging tilt rod. This description is for a typical venetian blind, but there may, of course, be other styles and types of venetian blind which do not fit exactly within the above description.

Although venetian blinds are a fairly versatile window covering (because they may be operated to allow varying degrees of light and/or ventilation, as well as sight access, therethrough) it is not common with present venetian blind constructions to close only a part of the blind while allowing another part to remain open, or vice versa. While it is known in the prior art to do such (see for example U.S. Pat. No. 4,869,308 issued to Chang), design and manufacture considerations limit its feasibility in practice. More specifically, prior art methods require either an extensive modification of an existing blind or else a complicated, expensive design and manufacture process to create a new blind. Further, once these modifications or designs have been instigated, they cannot be readily reversed to allow uniform movement of all the slats.

The need for a system which can easily convert an existing venetian blind into a blind having varying slat orientation capabilities, and back again, should be apparent. For example, it may be desirable to close the upper portion of a venetian blind to maintain the incoming light at a preferred reduced level, while keeping the lower portion of the blind in an open position to allow sight access, indirect light and/or ventilation therethrough. Alternatively, it may be desirable to close the lower portion of the blind for purposes of privacy, while maintaining the upper portion of the blind in an open position to allow light, ventilation and limited sight access therethrough.

SUMMARY OF THE INVENTION

It is an object of the invention to provide a system for controlling the operation of venetian blinds to allow the opening of one portion of the blind while maintaining the other portion closed, or vice versa.

It is a further object of the invention to provide such a system which is simple in construction and easy to implement.

It is an additional object of the invention to provide such a system which may be utilized in conjunction with a conventional venetian blind.

It is still another object of the invention to provide such a system which may be readily installed on and removed from a conventional venetian blind, without requiring modification of the blind.

The above and other objects of the invention are realized in a specific illustrative embodiment of a clip which allows for clamping one of two tilt strings to the associated lift string at a particular level in a venetian blind, to thereby prevent vertical movement of such tilt string relative to the lift string below the location of the clip. Relative vertical movement is still allowed above the location of the clip and so when the venetian blind control mechanism is operated to cause rotation of the slats, through most of the rotation only those slats above the location of the clip are allowed to rotate. In this manner, the degree of rotation of the slats above the clip can be made different from that of the slats below the clip. For example, those slats above the location of the clip may be opened while the slats below the clip remain closed, and vice versa.

BRIEF DESCRIPTION OF THE DRAWINGS

The above and other objects, features and advantages of the invention will become apparent from a consideration of the following detailed description presented in connection with the drawings in which:

FIGS. 4*a* and 4*b* show perspective views of one embodiment of a venetian blind clip made in accordance with the principles of the present invention and FIG. 4C shows and enlarged end, cross-sectional view of the clip of FIG. 4A;

FIG. 5A is a perspective view of another embodiment of a venetian blind clip made in accordance with the principles of the present invention and FIG. 5B is an enlarged end, cross-sectional view of the clip of FIG. 5A;

DETAILED DESCRIPTION

Figure 1:
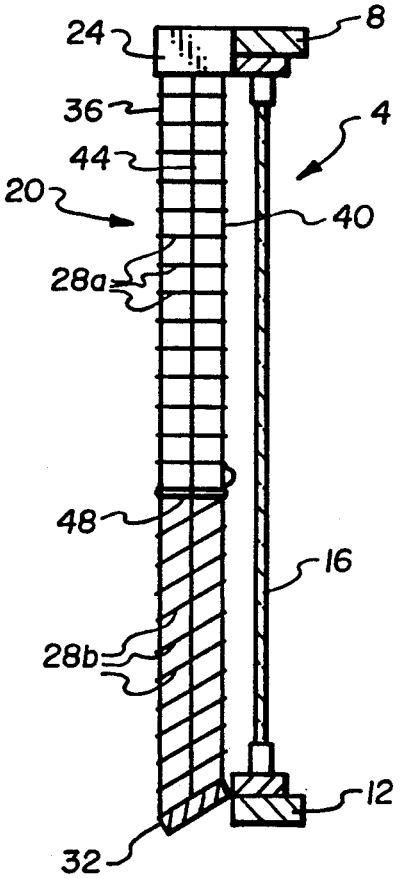
FIG. 1 is a side, elevational view of a venetian blind operated and positioned in accordance with one embodiment of the present invention.

Referring to FIG. 1, there is shown a side, cross-sectional view of a window 4 having a top frame 8 and bottom frame 12 surrounding a window pane 16.

Mounted on the inside of the window 4 is a venetian blind 20 which includes a head rail bar 24 attached to the inside surface of the window frame 8, a plurality of slats 28 vertically spaced apart and horizontally positioned to be generally parallel with one another, and a bottom rail 32 located at the bottom of the blind.

The blind also includes several pairs of tilt strings spaced apart along the width of the blind, with one string 36 of each pair extending vertically downwardly from the head rail 24 along the front edges of the slats 28 to the bottom rail 32, and a second string 40 of each pair also extending vertically downwardly from the head rail 24, but along the back edges of the slats to the head rail 32. Bridging ties (not shown in the drawing) extend from the front tilt string 36 to the rear tilt string 40 under each of the slats 28 to support the slats. Lift strings, such as lift string 44, extend from the head rail 24 downwardly through openings in the slats 28 generally adjacent to each pair of tilt strings to connect onto the bottom rail 32.

The operation of a venetian blind is well-known in which the slats 28 may be rotated about their long axes by operation of two tilt cords (not shown) or a tilt rod (also not shown) to various angular positions to vary the amount of sight access, light and/or ventilation allowed to pass through the blind. In FIG. 1, an upper group of slats 28*a* has been rotated to a fully "open" position in which the slats 28*a* are positioned to be generally parallel with the horizontal both in the lateral direction as well as the long direction to allow light to pass through the window 4 and through the blinds 20 to the inside of the dwelling in which the blinds 20 are mounted. A lower group of slats 28*b* has been rotated counter clockwise (looking down at FIG. 1) to a more "closed" position in which the slats allow less light therethrough from outside the window to the inside of the dwelling. Both the "open" and "closed" positions are well-known in the structure and operation of venetian blinds generally.

In the embodiment of the present invention illustrated in FIG. 1, the venetian blind 20 is manipulated to open an upper portion of the blind 20 and close a bottom portion. To do this, the tilt cords or tilt rod are manipulated to place all of the slats 28 in the "open" position as shown for slats 28*a*. A clip 48 is then clamped onto the middle lift string 44 and the rear or outside tilt string 40 to prevent relative vertical movement therebetween. The lift strings 44 are then pulled slightly upwardly (by a separate graspable pull string) to produce slack in the rear or outside tilt string 40 above the clip 48. This action closes the slats 28*b* of the bottom portion of the blind 20, while allowing the slats 28*a* above clip 48 to remain open. Finally, the tilt rod or tilt cords may be manipulated to close the upper portion of the blind 20, at which time the bottom portion of blind 20 below clip 48 will open (counter clockwise rotation). Manipulation of the tilt rod or tilt cords in the opposite direction (clockwise rotation) will simply close the top portion of the blind 20 leaving the entire blind 20 in a "closed" position.

Thus, by simply placing a clip 48 (or a number of clips) on the outside tilt string 40 and the associated lift string 44, and then manipulating the blind 20 in a conventional manner, one portion of the blind 20 will close while the other portion remains open, and vice versa.

Figure 2:
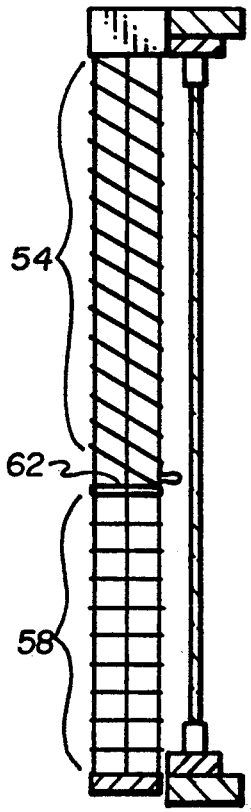
FIG. 2 is a side, elevational view of a venetian blind operated and positioned in accordance with another embodiment of the present invention.

FIG. 2 illustrates another mode in which the invention may be practiced wherein an upper portion of slats 54 is closed while a lower portion of slats 58 is opened. In this case, the blind 20 is operated so that all of the slats 54 and 58 are in the closed position at an angle exactly opposite of that shown for slats 28*b* of FIG. 1. A clip 62 is then clamped over the middle lift string and the outside tilt string, as shown in FIG. 2, and the control mechanism of the blind is operated to rotate the slats in the clockwise direction which will cause the upper group of slats 54 to rotate from a closed position to an open position and then further to a closed position again, whereas the lower group of slats 58 will simply rotate to the open position shown. The blind thus will have an upper group of slats 54 which are closed and a lower group of slats 58 which are opened as desired.

Figure 3:
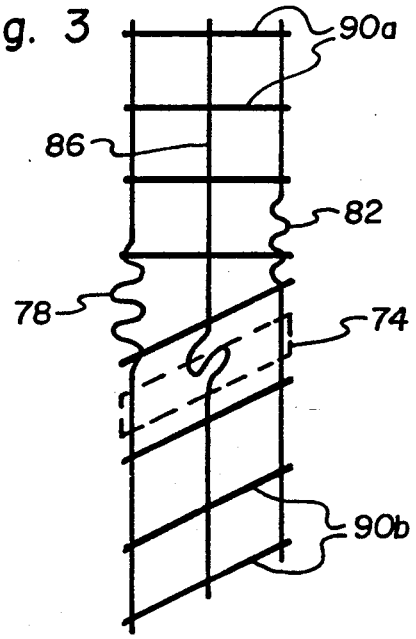
FIG. 3 is a side, elevational view of a venetian blind operated and positioned in accordance with still another embodiment of the present,, invention.

FIG. 3 shows still another embodiment of the invention in which a different type of clip 74 is utilized to create slack in both tilt strings 78 and 82 by a specialized attachment to a lift string 86. In particular, the slats 90 of FIG. 3 are first positioned in the closed condition as shown for slats 90*b*. The outside tilt string 82 is clamped by the clip 74. The clip 74 is then attached to the middle lift string 86 and either the lift string is wrapped thereabout or the clip is cinched upwardly on the lift string. This will be discussed in greater detail later. The blind control mechanism is then operated to cause the slats above the clip 74 to rotate to an open position such as shown for slats 90*a* of FIG. 3. The slats below the clip 74 remain closed. Again, an upper portion of the blind is then allowed to be opened while a lower portion remains closed.

FIGS. 4A through 8 show various embodiments of a venetian blind clip suitable for practicing the present invention. In FIGS. 4A and 4B, a hinge clip 104 is shown in a closed position and open position respectively. The clip 104 includes a pair of fingers 108 and 112 joined together at one end by a hinge 116 to allow free ends 108*a* and 112*a* to pivot between the closed position shown in FIG. 4A and the open position shown in FIG. 4B. The hinge 116 is of a conventional design and might include an axle 116*a* which extends from finger 108 to seat in an opening 116*b* of finger 112.

Formed in the free ends 108*a* and 112*a* of the fingers is a latch mechanism shown in an enlarged, cross-sectional end view at 120. As shown in this enlarged view, free end 112*a* includes a protruding nipple 124 which, when the free ends of the clip are mated, projects into and latches in a slot 128 formed in the free end 108*a*. Of course, a variety of latching mechanisms could be utilized.

When the clip 104 is in the closed position shown in FIG. 4A, a slot or gap 132 is presented between the facing surfaces of the fingers 108 and 112 to accommodate and clamp therebetween a tilt string 136 and lift string 140, to prevent relative vertical movement therebetween. An opening 144 is formed between facing surfaces of the fingers 108 and 112 to accommodate the other tilt string 148 and allow a sliding of the string therethrough.

The clip 104 of FIGS. 4A and 4B may be used in the FIG. 1 and FIG. 2 methodologies for preparing the blinds with one portion open and one portion closed.

FIG. 5A shows another embodiment of a clip 204 shown in a closed position to clamp tilt string 208 and lift string 212, to prevent relative vertical movement therebetween, and to confine but let slide the other tilt string 216. The clip 204 of FIG. 5A is similar to the clip 104 of FIGS. 4A and 4B, the primary difference being that the clip 204 is made from a single piece of material and includes a loop spring hinge 220 formed integrally with fingers 224 and 228. When the clip 204 is opened, the spring hinge 220 simply flexes to allow the movement apart of fingers 224 and 228 to allow placement of the clip over the selected tilt and lift strings.

An alternative latch structure is shown in enlarged, end cross-sectional view at 232. In this embodiment, a small nipple 236 is formed on a facing surface of finger 228 to register in a slot 240 formed in finger 224. The spring hinge 220 of the finger 204 maintains the finger in the closed position and so the latch shown at 232 need not provide a locking function but rather simply a guide function to cause the ends of the fingers 224 and 228 to properly mate.

Figure 6A:
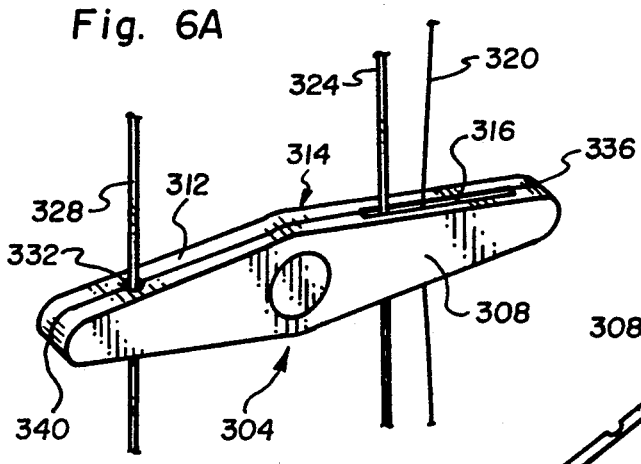
FIGS. 6*a* and 6*b* show perspective views of still another embodiment of the present invention.
Figure 6B:
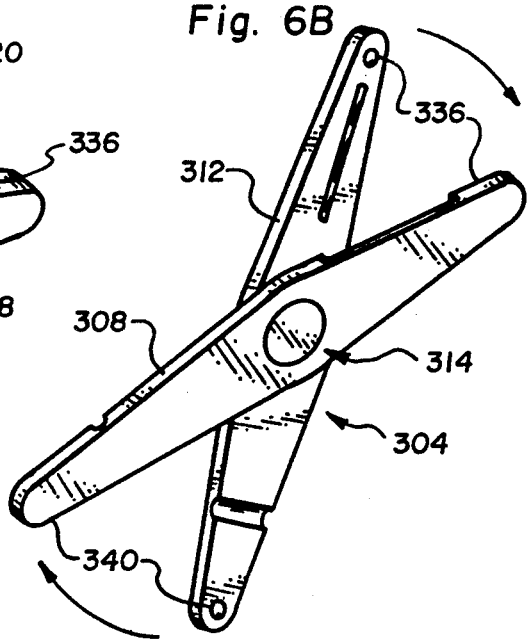

FIGS. 6A and 6B show another embodiment of a clip which may be used with the methodology illustrated in FIGS. 1 and 2. The clip 304 in this embodiment a pair of bars 308 and 312 are hingedly joined at their midpoints to rotate relative to one another as illustrated in FIG. 6B. A slot 316 is formed between facing surfaces of the fingers 308 and 312 on one side of the hinge 314 to clamp tilt string 320 and lift string 324, as shown in FIG. 6A. Another tilt string 328 is threaded through eyelet 332 formed in the facing surfaces of the fingers 308 and 312, on the opposite side of the hinge 314 from where slot 316 is formed. A latch structure 336 is formed at the ends of fingers 308 and 312 adjacent the slot 316 to hold the clip 304 in the closed position shown in FIG. 6A. A similar latch structure 340 is also formed at the opposite end of the clip. These latch structures might simply include a nipple which registers into a corresponding dimple to hold the ends of the fingers together.

FIGS. 7 and 8 show perspective view of embodiments of venetian blind clips suitable for use with the methodology illustrated in FIG. 3. Referring to FIG. 7, there is shown a clip 404 having a pair of arms 408 and 412 hingedly joined at one end 416 to allow the opposite ends to pivot toward and away from one another. A latch mechanism is formed at the other ends of the arms 408 and 412 to include an opening 420 and a tab 424 which, when the arms are pivoted toward one another, moves through the opening 420 to latch the free ends of the arms together.

Near the hinged ends of the arms 408 and 412 are a pair of vise pads 428 and 432, each disposed on an opposite facing wall of the arms to mate and hold a tilt string 436 therebetween when the clip is placed in the closed, latched position. Such vise pads 428 and 432 could simply be formed integrally with the material of which the clip 404 is formed.

Rotatably disposed in a slot 440 of the arm 412 is a slack adjustment winding mechanism 444. The mechanism 444 includes a graspable handle 448, an axle 452 which extends from the handle through the slot 440, a bar 456 mounted to be generally perpendicular with the axle 452 (FIG. 7B), and a pair of pins 460 and 464 which extend forwardly towards the arm 408 from opposite ends of the bar 456 to wipe against the facing surface of the arm 408 as the handle 448 is rotated.

Figure 7B:
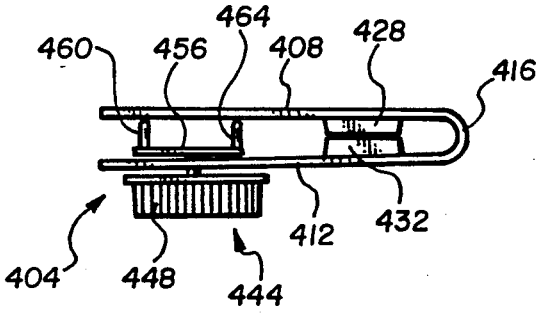
FIGS. 7*a* and 7*b* show a perspective view and a side, elevational view respectively of an embodiment of a venetian blind clip for producing slack in the lift strings of the blind, made in accordance with the principles of the present invention.
Figure 7A:
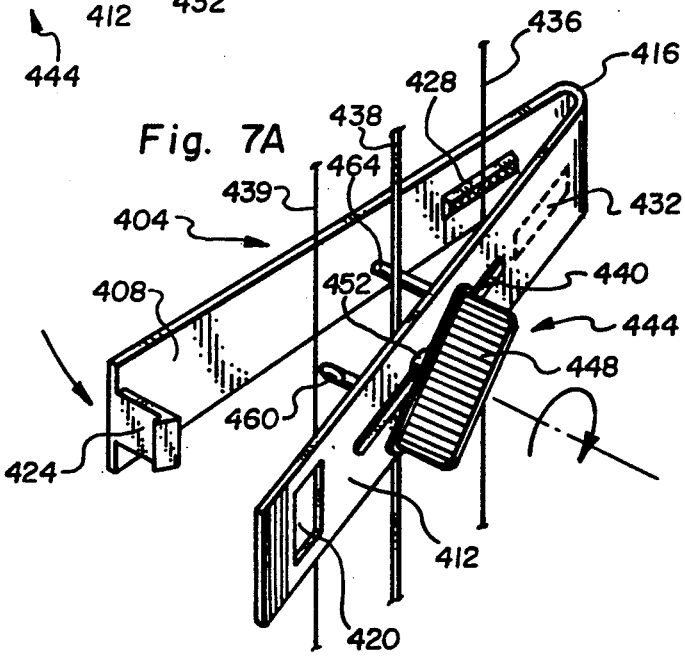

In use, the clip 404 is placed about the tilt and lift strings of a venetian blind so that the fingers 460 and 464 are positioned on either side of the lift string 438, as shown in FIG. 7A. The clip 404 is then locked in the closed position so that the vise pads 428 and 432 grip and hold the tilt string 436. The handle 448 is then rotated to wind the lift string 438 about the fingers 460 and 464 to thus raise that portion of the blind below the location of the clip and produce slack in tilt strings 436 and 439.

Figure 8A:
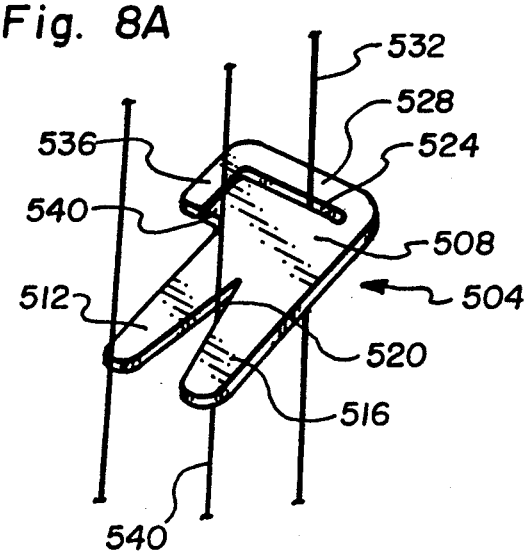
FIGS. 8*a* and 8*b* are perspective views of another embodiment of a clip for producing slack in the lift strings of a venetian blind.
Figure 8B:
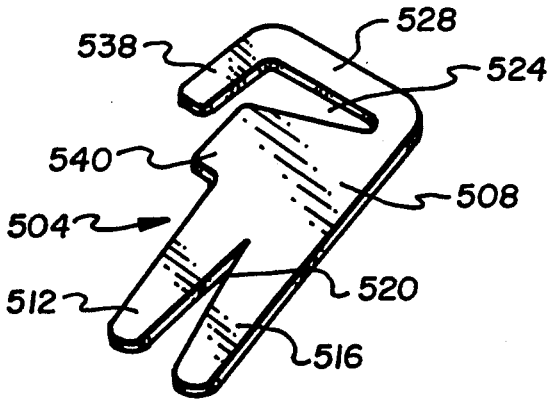

FIG. 8 shows another embodiment of a clip for use with the methodology illustrated in FIG. 3. This clip 504 includes a plate of flexible material having a base section 508, a pair of fingers 512 and 516 extending generally parallel from the base to define a hitching slot 520. Formed on the other side of the base section 508 is a gripping slot 524 and a flexible finger 528 which may be flexed away from the base section 508 to allow positioning a tilt string 532 in the slot. The finger 528 includes a latch section 536 which latches and locks with a side extension 540 of the base section 508. FIG. 8B shows the finger 528 flexed upwardly from the base section 508 to allow positioning of the tilt string 532 in the slot 524.

In use, the clip 504 is mounted on a venetian blind by placing the tilt string 532 in the slot 524 to lock it therein, and the lift string 540 is positioned in the hitching slot 520, as shown in FIG. 8A. The clip 504 is then moved upwardly relative to the blind to produce slack in tilt string 532 and, once the desired slack is produced the lift string is fixed in the hitching slot 520 to maintain the clip 504 in that position. The blind can then be manipulated as indicated in connection with FIG. 3 to open and close desired portions of the blind.

Figure 9:
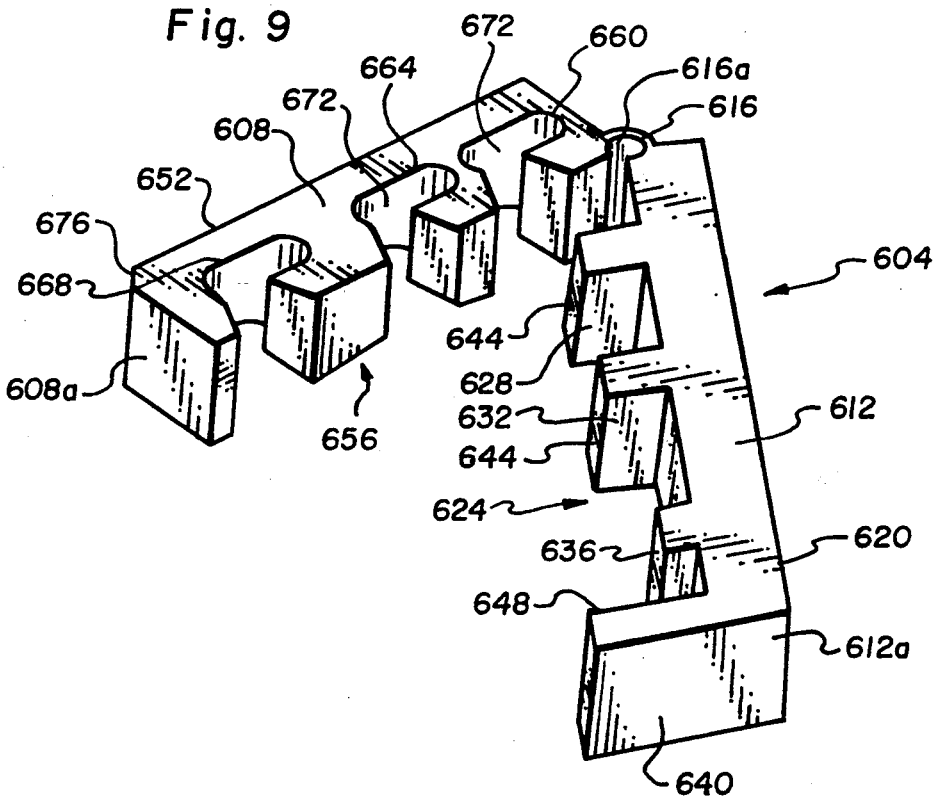
FIG. 9 is a perspective view of another embodiment of a venetian blind clip made in accordance with the principles of the present invention.

FIG. 9 illustrates still another preferred embodiment of a clip suited for use with the methodology of FIGS. 1 and 2. Clip 604 comprises two generally rectangular arms 608 and 612 connected together at a hinged joint 616, arm 612 being somewhat longer than arm 608. Joint 616 is located at a corner of both arms 608 and 612 such that the free ends 608*a* and 612*a* of the arms 608 and 612 pivot toward and away from each other. Hinged joint 616 is of common construction comprising perhaps a plastic tab or live hinge 616*a* about which arms 608 and 612 freely pivot. Arm 612 comprises a smooth outer side 620 and an inner side 624 which has four fingers 628, 632, 636 and 640 extending outwardly therefrom in a direction normal to that of the major plane of arm 612.

Fingers 628 and 632 are located closest to the hinged joint 616 and are of the same size. Each has a series of horizontally disposed knurls 644 on its outermost surface for a purpose explained hereinafter. Knurls 644 are best formed integrally with the material of which 604 is formed. It is readily apparent from FIG. 9 that finger 636 is significantly shorter than fingers 628 and 632 and does not have any knurls 644 on its outer surface. Further, finger 636 is spaced further away from finger 632 than is finger 632 from finger 628. FIG. 9 also shows finger 640 to be somewhat longer than fingers 628 and 632 and to not have any knurls 644, while comprising a tongue 648 which serves as one half of the locking mechanism for clip 604.

Arm 608 comprises a smooth outer side 652 and an inner side 656 which has cut therein three substantially recesses 660, 664 and 668. Recesses 660 and 664 are radially aligned with fingers 628 and 632 respectively, such that when clip 604 is closed, finger 628 fits snugly into recess 660, and finger 632 fits snugly into recess 664. The recesses 660 and 664 have horizontally disposed knurls 672 which cooperate with knurls 644 of arm 612 to prevent slippage of a tilt string or lift string sandwiched therebetween when the clip 604 is closed.

Shorter finger 636 is accommodated in recess 668 when the clip 604 is closed, recess 668 containing no knurls. The absence of a snug fit of finger 636 into recess 668 and the lack of knurls combine to allow unrestricted axial movement of a tilt string placed in recess 668 and locked therein by closing clip 604.

The locking mechanism for clip 604 comprises the tongue 648 of finger 640 and an angled face 676 formed by cutting off the rectilinear corner of arm 608 opposite to the corner at which hinged joint 616 is located. The locking mechanism is engaged by simply pivoting the free ends of arms 608 and 612 toward each other until tongue 648 "snaps" onto angled face 676. Thus, in the closed or locked position, arms 608 and 612 are parallel to each other, and the inner face of tongue 648 and angled face 676 are contiguous.

In practice, clip 604 is attached to a blind by placing the tilt string to be secured (not shown) into recess 660, the lift string (not shown) into recess 664, and the other tilt string into recess 668. The clip is then closed to secure the blind as needed.

Figure 10:
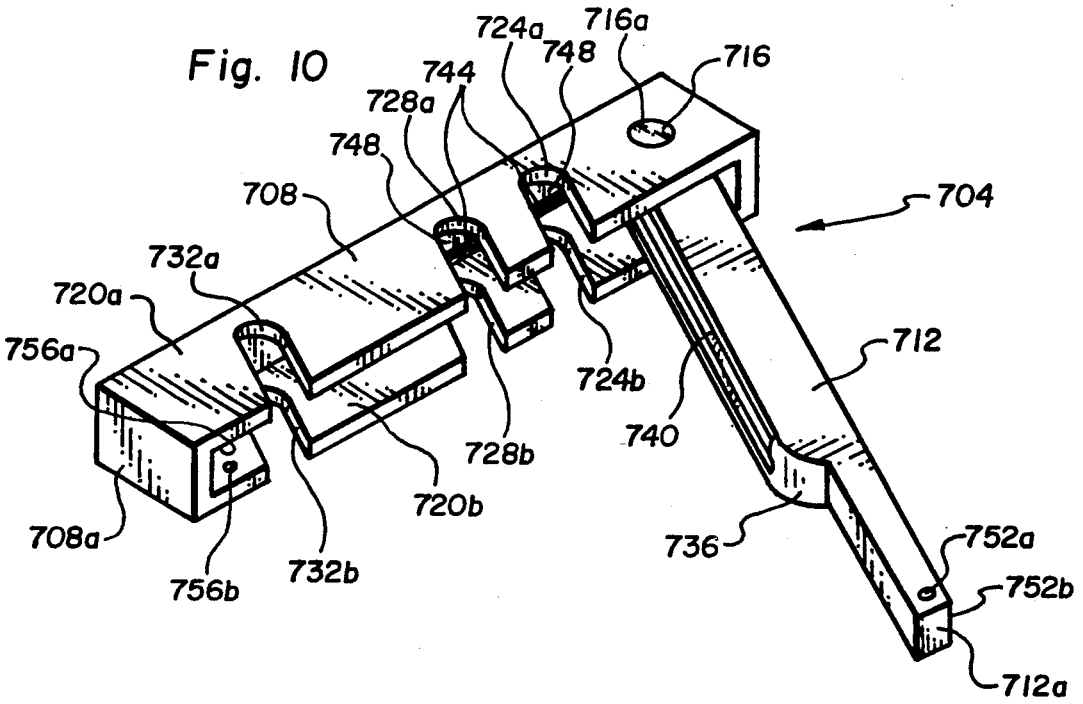
FIG. 10 is a perspective view of still another embodiment of a venetian blind clip made in accordance with the present invention.

FIG. 10 also shows another embodiment of a clip to be used in accordance with the methodology of FIGS. 1 and 2. This embodiment shows a clip 704 having two arms 708 and 712 pivotally connected at one end by a hinged joint 716 so that free ends 708*a* and 712*a* can freely rotate. Arm 708 has the general shape of a hollow rectangular box having one of the short sides open and containing three notches or indentations cut into each of the broad sides 720*a* and 720*b*. Specifically, corresponding notches 724*a* and 724*b* and 728*a* and 278*b* are cut at a slight angle to the major axis of arm 708 and are located relatively closely together. Notches 732*a* and 732*b* are also cut at the same slight angle to the same major axis but by contrast are located a further distance from notches 728*a* and 728*b* than notches 728*a* and 728*b* are from notches 724*a* and 724*b*. As shown, notches 724*a* and 724*b*, 728*a* and 728*b*, and 732*a* and 732*b* are aligned in a direction normal to the planes of broad faces 720*a* and 720*b*.

Arm 712 has a generally solid rectangular shape and has a larger diameter at its pivoted end than at its free end 712*a*. The pivoted end of arm 712 is inserted into the hollow interior of arm 708 and pivotally connected thereto by a conventional hinging device such as hinging pin or shaft 716*a*. At a location on arm 712 corresponding to a location on arm 708 between notches 728*a* and 728*b*, and 720*a* and 720*b*, a sudden taper 736 on the inside face of arm 712 decreases the diameter thereof (in a direction from the hinged joint 716 to open end 712*a*). On the inside face of the portion of arm 716 having the larger diameter, a vise pad 740 is firmly attached. A corresponding vise pad 744 is attached to the interior face 748 of the closed short side of arm 708.

A latching mechanism is provided in the form of two nipples 752*a* and 752*b* on opposing sides of the free end 712*a* of arm 712, and corresponding receiver sockets 756*a* and 756*b*. In use, a tilt string (not shown) to be secured in place into notches 724*a* and 724*b*, the lift string (not shown) is placed into notches 728*a* and 728*b*, and the other tilt string (not shown) is placed into notches 732*a* and 732*b*. The free ends 708*a* and 712*a* and then brought together until the latching mechanism engages, at which point the first tilt string and lift string are prevented from moving relative to each other, due to compression between the vise pads 740 and 744, while the other tilt string is free to move axially through the clip 704.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. In use with a venetian blind having a head rail for mounting at the top of a window frame over which the blind is to be positioned, first and second pairs of tilt strings depending from the head rail at spaced-apart locations, a first string of each pair being disposed closest to the window and a second string of each pair being disposed farthest from the window, first and second arrays of bridging ties extending between the strings of the first and second pairs respectively in vertically spaced-apart locations, first and second lift strings depending from the head rail generally between the first and second pairs of tilt strings respectively, a bottom rail attached to the lower ends of the lift strings, a plurality of horizontally disposed, vertically spaced-apart slats positioned between the first and second strings of the pairs of tilt strings, each resting on respective bridging ties of the first and second arrays so that as the first and second strings of the pairs of tilt strings are moved vertically relative to one another, the slats are caused to rotate about their long axes generally in unison, and each slat having a pair of spaced-apart openings through which respective lift strings extend, and control means disposed in the head rail and operable to move the first and second strings of the pairs of tilt strings vertically relative to one another, apparatus for selectively allowing rotation of an upper group of slats by a certain degree different from the degree of rotation of a lower group of slats comprising means for clamping together a lift string and a tilt string to prevent relative vertical movement therebetween so that operation of the control means causes rotation of the slats above the location of the clamping means by an amount different from the amount of rotation of the slats below the location of the clamping means.

2. Apparatus as in claim 1 wherein said clamping means comprises a pair of fingers hingedly joined at one end to pivot between an open position, in which the free ends of the fingers are separated, and a closed position, in which the free ends are mated and the facing surfaces of the fingers grip the lift string and tilt string to prevent relative vertical movement therebetween, said free ends including latch means for holding the clamping means in the closed position when the free ends are mated.

3. Apparatus as in claim 2 wherein the facing surfaces of the fingers are formed to define an eyelet, when the clamping means is in the closed position, through which the unclamped tilt string may be threaded to move vertically relative to the lift string.

4. Apparatus as in claim 3 wherein the hinged joint comprises a loop of flexible material integrally formed with the hinged ends of the fingers, to allow the fingers to pivot between the open and closed positions.

5. Apparatus as in claim 3 wherein the hinged joint comprises an opening formed in one end of one of the fingers, and an axle projecting from one end of the other finger and insertable into the opening in the one finger to allow pivoting of the fingers relative to one another.

6. Apparatus as in claim 1 wherein said clamping means comprises a pair of bars hingedly joined at their middles to rotate relative to one another in a scissor-like fashion between an operating position, in which the bars are aligned and facing surfaces of the bars on one side of hinged joint grip the lift string and tilt string to prevent relative vertical movement therebetween, and an open position, in which the bars positioned at an angle relative to one another, and latch means formed on the bars for holding the bars in the operating position.

7. Apparatus as in claim 6 wherein the facing surfaces of the bars on other side of the hinged joint are formed with an eyelet, when the bars are in the operating position, through which the unclamped tilt string may be threaded to move vertically relative to the lift string.

8. Apparatus as in claim 7 wherein the hinged joint comprises an opening formed generally in the middle of one of the bars, and an axle protruding generally from the middle of the other bar for insertion into the opening in said one bar.

9. Apparatus as in claim 1 wherein said clamping means comprises a pair of arms hingedly joined at one end to pivot between an open position, in which the free ends of the arms are separated, and a closed position, in which the free ends of the arms are mated, latch means disposed at the free ends of the arms to lock the clamping means in the closed position when the free ends are mated, vise means disposed near the hinged joint of the arms for gripping a tilt string placed therebetween, and slack adjustment means rotatably disposed in one of the arms to contact and wrap thereabout a lift string to thereby produce slack in the associated tilt strings above the location of the clamping means when the adjustment means is rotated with the lift string disposed between the arms, and with a tilt string gripped by the vise means.

10. Apparatus as in claim 9 wherein said one arm includes an opening, and wherein said slack adjustment means includes an axle disposed to rotate within the opening in said one arm, a knob mounted on one end of the axle adjacent the outside surface of said one arm, and a bar mounted at a midpoint on the other end of said axle adjacent the inside facing surface of said one arm, and having a pair of fingers, each projecting toward the other arm from opposite ends of said one arm, so that as the knob is rotated, the fingers engage and wrap thereabout the lift string to thereby produce slack in the associated tilt strings above the location of the clamping means.

11. Apparatus as in claim 9 wherein the facing surfaces of said arms are formed with a gap therebetween, when the clamping means is in the closed position, through which the unclamped tilt string may be threaded.

12. In combination with a venetian blind having a plurality of generally vertically spaced-apart, horizontally disposed slats held in position by two pair of tilt strings, a first string of each pair extending vertically on a front side of the slats, and a second string of each pair extending vertically on a back side of the slats opposite the first string, and which, when moved vertically relative to one another, cause rotation of the slats about their long axes generally in unison to open and close the blind, said blind further having two lift strings, each extending vertically, adjacent a respective pair of tilt strings, a clip for clamping a lift string in a fixed vertical position relative to an adjacent tilt string to prevent relative vertical movement of the clamped strings, said clip comprising a pair of fingers pivotally joined together to move between an open position, in which at least portions of each finger are positioned apart from one another, and a closed position, in which said portions are positioned in a mating relationship to hold the clamped strings therebetween.

13. A method of manipulating a venetian blind to selectively open a portion thereof and close another portion thereof, said venetian blind including a plurality of slats spaced apart vertically from one another and disposed to extend horizontally and in parallel with one another, a head rail disposed at the top of the blind for mounting over a window, at least two pair of tilt strings, a first string of each pair extending vertically downwardly from the head rail on a front side of the slats and a second string of each pair extending vertically downwardly from the head rail on a back side of the slats opposite the corresponding first string, at least two arrays of bridging ties, each array extending between the first and second tilt strings of a corresponding pair under the slats to provide support therefor, at least two lift strings, each associated with a pair of tilt strings and extending vertically downwardly from the head rail, a bottom rail attached to the lower ends of the lift strings at the bottom of the blind, a control mechanism operable to cause the first tilt string of each pair to move vertically relative to the second tilt string of each pair to thereby cause the slats to rotate about their long axes to vary the amount of light allowed through the blind, and a light mechanism operable to cause the lift strings to move upwardly and thereby raise the bottom rail and any slats encountered by the bottom rail as it is raised, said method comprising operating the control mechanism to rotate the slats to a horizontal position;

clamping a clip onto each lift string and the second string of the associated pair of tilt strings thereby preventing relative movement of the clamped lift string and second tilt string below the clip, at the same time allowing for free axial movement of first string of the associated pair of tilt strings;

pulling the lift strings slightly upwardly to create slack in the second strings of the associated pair of tilt strings; and selectively operating the control mechanism to open a portion of the slats while closing the remainder.

14. Apparatus as in claim 1 wherein said clamping means comprises a first arm and a second arm hingedly joined at one end to pivot between an open position, in which the free ends of the first and second arms are separated, and a closed position, in which the free ends are mated, said first arm comprising a plurality of nipples and said second arm comprising a plurality of corresponding recesses, said nipples and corresponding recesses acting in combination to clamp onto a tilt string and on a lift string to prevent relative vertical movement therebetween when the arms are in the closed position, and wherein said free ends of the first and second arms in combination comprise latch means for holding the clamping means in the closed position.

15. Apparatus as in claim 1 wherein said clamping means comprises a first arm and a second arm hingedly joined at one end to pivot between an open position, in which the free ends of the first and second arms are separated, and a closed position, in which the free ends are mated, said first arm comprising a plurality of notches for receiving a lift string and a tilt string, said second arm securing said tilt string and said lift string against said first arm to prevent relative vertical movement therebetween when in the closed position, and wherein said first and second arms in combination comprise latch means for holding the clamping means in the closed position.

16. A method of manipulating a venetian blind to selectively open a portion thereof and close another portion thereof, said venetian blind including a plurality of slats spaced apart vertically from one another and disposed to extend horizontally and in parallel with one another, a head rail disposed at the top of the blind for mounting over a window, at least two pair of tilt strings, a first string of each pair extending vertically downwardly from the head rail on a front side of the slats and a second string of each pair extending vertically downwardly from the head rail on a back side of the slats opposite the corresponding first string, at least two arrays of bridging ties, each array extending between the first and second tilt strings of a corresponding pair under the slats to provide support therefor, at least two lift strings, each associated with a pair of tilt strings and extending vertically downwardly from the head rail, a bottom rail attached to the lower ends of the lift strings at the bottom of the blind, a control mechanism operable to cause the first tilt string of each pair to move vertically relative to the second tilt string of each pair to thereby cause the slats to rotate about their long axes to vary the amount of light allowed through the blind, and a light mechanism operable to cause the lift strings to move upwardly and thereby raise the bottom rail and any slats encountered by the bottom rail as it is raised, said method comprising operating the control mechanism to rotate the slats to a horizontal position;

attaching a clip to the second tilt string of a pair of tilt strings;

moving the clip upwardly to produce slack in the second tilt string immediately above the clip;

attaching the clip to the associated lift string;

selectively operating the control mechanism to rotate open the slats above the clip.

17. The method of claim 16 wherein the step of moving the clip upwardly includes wrapping the lift string around the clip.

18. The method of claim 16 wherein the step of moving the clip upwardly includes cinching the clip upwardly on the lift string.

* * * * *